US005238219A

United States Patent [19]

Noelke et al.

[11] Patent Number: 5,238,219

[45] Date of Patent: Aug. 24, 1993

[54] THERMOSTATIC EXPANSION VALVE

[75] Inventors: Michael A. Noelke; J. George Leimbach, both of St. Louis, Mo.

[73] Assignee: Sporlan Valve Company, St. Louis, Mo.

[21] Appl. No.: 850,524

[22] Filed: Mar. 13, 1992

[51] Int. Cl.[5] ..... F16K 31/126

[52] U.S. Cl. ..... 251/61.3; 251/122

[58] Field of Search ..... 251/61.3, 61.5, 122, 251/364; 137/269, 505.44, 505.45

[56] References Cited

U.S. PATENT DOCUMENTS

| | | | |
|---|---|---|---|
| 1,513,645 | 10/1924 | Smith . | |
| 1,974,975 | 9/1934 | Stein et al. | 158/120 |
| 2,327,542 | 8/1943 | Matteson | 138/44 |
| 2,357,795 | 9/1944 | Dillman | 251/61.5 X |
| 2,524,569 | 10/1950 | Matteson | 138/46 |
| 2,630,140 | 3/1953 | Taylor | 251/63.3 |
| 2,822,789 | 2/1958 | Philips | 251/122 X |

FOREIGN PATENT DOCUMENTS

| | | | |
|---|---|---|---|
| 431838 | 7/1926 | Fed. Rep. of Germany | 13 D/22 |
| 1007662 | 2/1952 | France | 251/61.3 |

OTHER PUBLICATIONS

Danfoss Instructions T2/TE2 (HP) N-NM-NL-B dated Apr. 1947.

Alco Controls T1 Series Thermo R Expansion Valves dated Jun. 1991.

*Primary Examiner*—Robert G. Nilson

*Attorney, Agent, or Firm*—Cohn, Powell & Hind

[57] ABSTRACT

This thermostatic expansion valve (12) includes inlet and outlet fittings (22 and 24) connected to a valve body (30) having a diaphragm assembly (40) at one end. A replaceable cartridge (50) is disposed in the valve body (30) below the diaphragm assembly (40) having a passage (58) communicating with the inlet (22) and an end opening of predetermined size to define a valve port (60). A pin (72) is disposed below the valve port (60) and connected to the diaphragm assembly (40) by a pair of pushrods (76) so that the pin assembly (70) responds to modulation of the diaphragm assembly. A spring assembly (80) engages the pin assembly (70) tending to urge said assembly into a closed position.

11 Claims, 2 Drawing Sheets

FIG. 5.
(PRIOR ART)
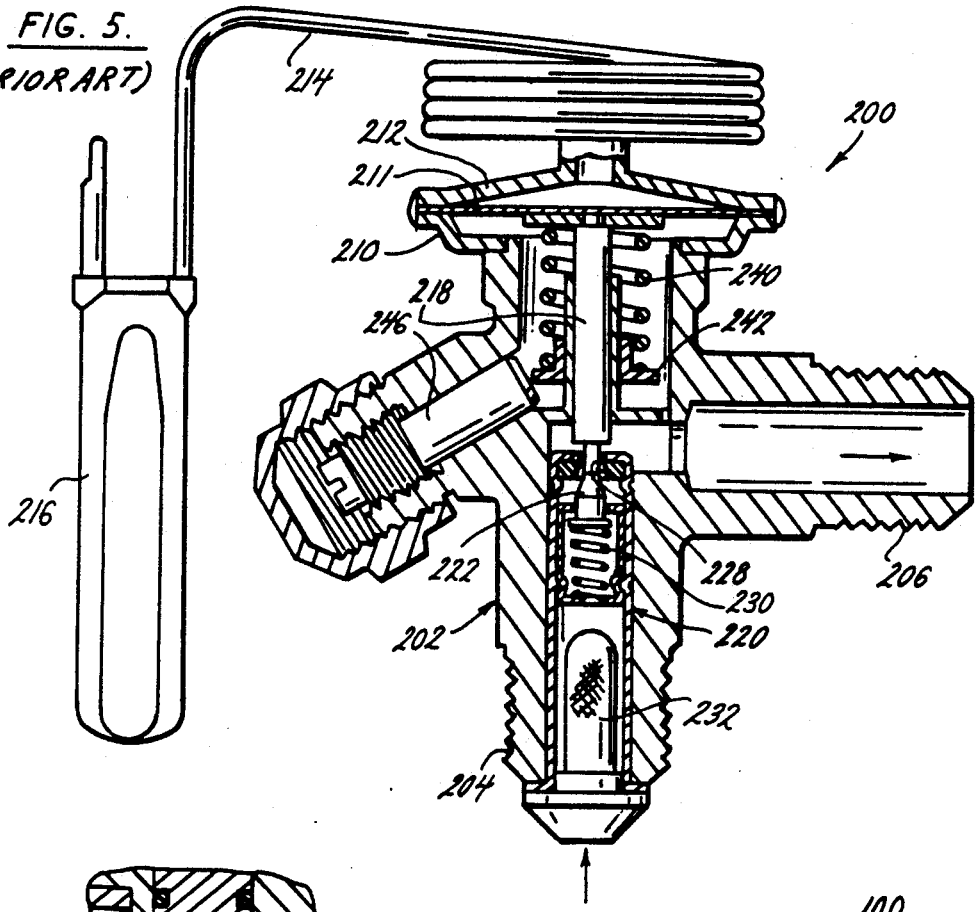
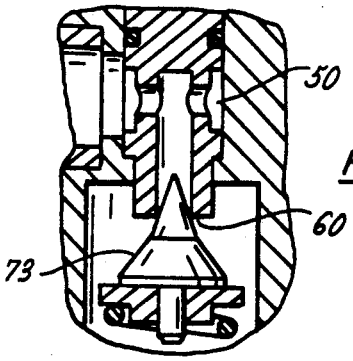
FIG. 2.
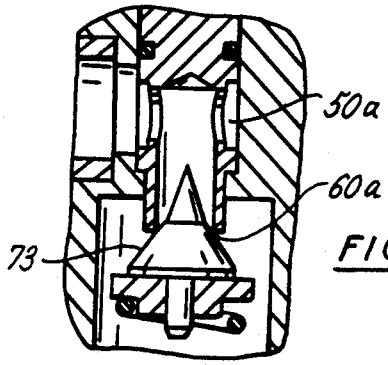
FIG. 3.
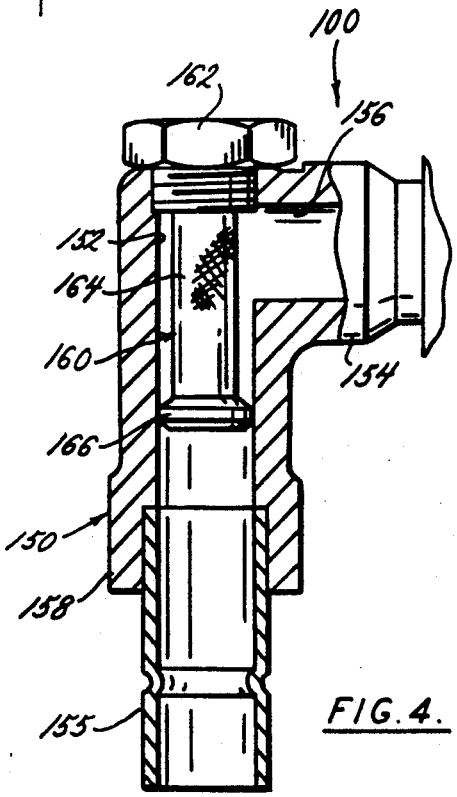
FIG. 4.

THERMOSTATIC EXPANSION VALVE

BACKGROUND OF THE INVENTION

This invention relates generally to thermostatic expansion valves for controlling refrigerant flow through a refrigeration system and particularly to a thermostatic expansion valve having a replaceable cartridge to change the capacity of the valve by providing a selected predetermined valve port for the valve.

It is sometimes necessary to change the capacity of a thermostatic expansion valve in the field. In addition, valves which have become inoperative often require complete replacement. In both instances replaceable cartridge thermostatic expansion valves have become popular. In the first instance, the use of a replacement cartridge permits the capacity of the valve to be changed without completely disassembling the valve. In the second instance, the use of a replaceable cartridge valve allows the field service mechanic to carry one type of basic valve and a set of variable cartridges and adjust the capacity by selecting a suitable cartridge for the basic valve in the field.

Replaceable cartridge thermostatic expansion valves have been in use for many years and those currently used suffer from some disadvantages. Typical of the prior art type of replaceable cartridge valve commonly in use is that manufactured by Danfoss, Inc. of Mahawa, N.J. as valve T2/TE2 and disclosed in its Instruction Sheet R1.01.VA.22 dated April 1987. The same or closely similar valve is also manufactured by Alco Controls Division, Emerson Electric Co. of St. Louis, Mo. as valve T1 and disclosed in its Catalog Sheet T1 Series Thermo R Expansion Valve dated June 1991. Both of these publications are incorporated by reference herein. This type of valve has the cartridge mounted in the inlet connection and utilizes a single pushrod leading from the diaphragm to engage the spring-loaded valve pin located in the cartridge. This arrangement results in a direction of refrigerant flow in the closing direction of the valve pin which tends to provide poor modulation. In addition, in this prior art valve the diaphragm assembly power element is integral with the valve body and the location of the superheat adjustment spring assembly directly below the diaphragm results in the spring assembly acting directly on the diaphragm. Accordingly, the diaphragm has to be compressed when assembling the valve and is not removable which has the disadvantage that it limits flexibility of the valve body in the field. Moreover, the superheat spring is adjusted by a force applied by an inclined, eccentrically located adjustment screw rather than by an axially located adjustment screw.

Another disadvantage of this construction is that the additional spring used to keep the pin in contact with the pushrod is very lightly loaded and provides little force to overcome contamination in the pin and port area. Moreover, the location of the cartridge in the inlet connection requires that it be held in place by a flare nut which leads to several problems. For example, if the nut is overtightened the stroke of the valve is increased such that the valve will not operate properly and the pin may not be properly seated. Also the valve cannot be made in a solder type connection, which is increasingly being used because it provides a leak free connection.

Another thermostatic expansion valve having a replaceable cartridge is disclosed in U.S. Pat. No. 2,327,542. In this valve the cartridge is transversely mounted relative to the valve inlet and the axis of the diaphragm and is housed within a removable screw. The cartridge includes a restricted orifice of predetermined diameter which does not cooperate with a valve pin.

The present replaceable cartridge valve overcomes these and other problems in a manner not disclosed in the known prior art.

SUMMARY OF THE INVENTION

This replaceable cartridge thermostatic expansion valve provides a means for changing the capacity of existing valves in the field and for facilitating replacement of inoperative valves.

The valve includes a valve body having upper and lower portions and an inlet and an outlet; a motor means at one end of the valve body providing means for modulating the valve; replaceable cartridge means disposed in the valve body upper portion below the motor means, said cartridge means having a passage communicating with the valve inlet and an end opening of predetermined size to define a valve port; a valve element movable relative to the valve port to control flow through the valve port between the inlet and outlet, said flow tending to move the valve element into the open position; means connecting the motor means to the valve element tending to move the valve element in response to modulation of said motor means, and resilient means disposed in the valve body lower portion below the replaceable cartridge means operatively engageable with the valve element, tending to close the valve.

It is an aspect of this invention that the replaceable cartridge has a predetermined length to define the stroke of the valve element.

It is another aspect of this invention that the replaceable cartridge includes side openings connecting the passage to the inlet.

It is still another aspect of this invention that the upper body portion includes a passage receiving the cartridge in threaded relation, and another aspect that the cartridge includes a wrench-receiving socketed upper end to facilitate installation.

It is another aspect of this invention the cartridge includes an annular seal to seal the motor means from the inlet.

It is yet another aspect of this invention that the valve element is generally conical and double-angled to suit selected valve ports.

An aspect of this invention is that the body upper portion includes an abutment engageable by the cartridge to provide a stop means locating the cartridge in the valve body.

Another aspect of this invention is that the valve element includes a pin and a carrier, the resilient means includes a superheat spring engageable with the carrier, and the body includes an abutment engageable by the carrier to limit upward movement by the carrier whereby the valve element and the superheat spring can be pre-installed with the spring in a compressed condition.

Yet another aspect of this invention is that the inlet and outlet are adapted for use with solder connections.

It is an aspect of this invention to provide a replaceable cartridge thermostatic expansion valve which is simple in construction, inexpensive to manufacture and easy to install.

BRIEF DESCRIPTION OF THE DRAWING

FIG. 2 is a fragmentary cross sectional view showing a double angle pin.

FIG. 3 is a similar view showing the double angle pin used with a cartridge having a larger port.

FIG. 4 shows a modified valve used with a soldered fitting.

FIG. 5 is a cross section through a conventional prior art valve.

DESCRIPTION OF THE PREFERRED EMBODIMENT

Figure 1:
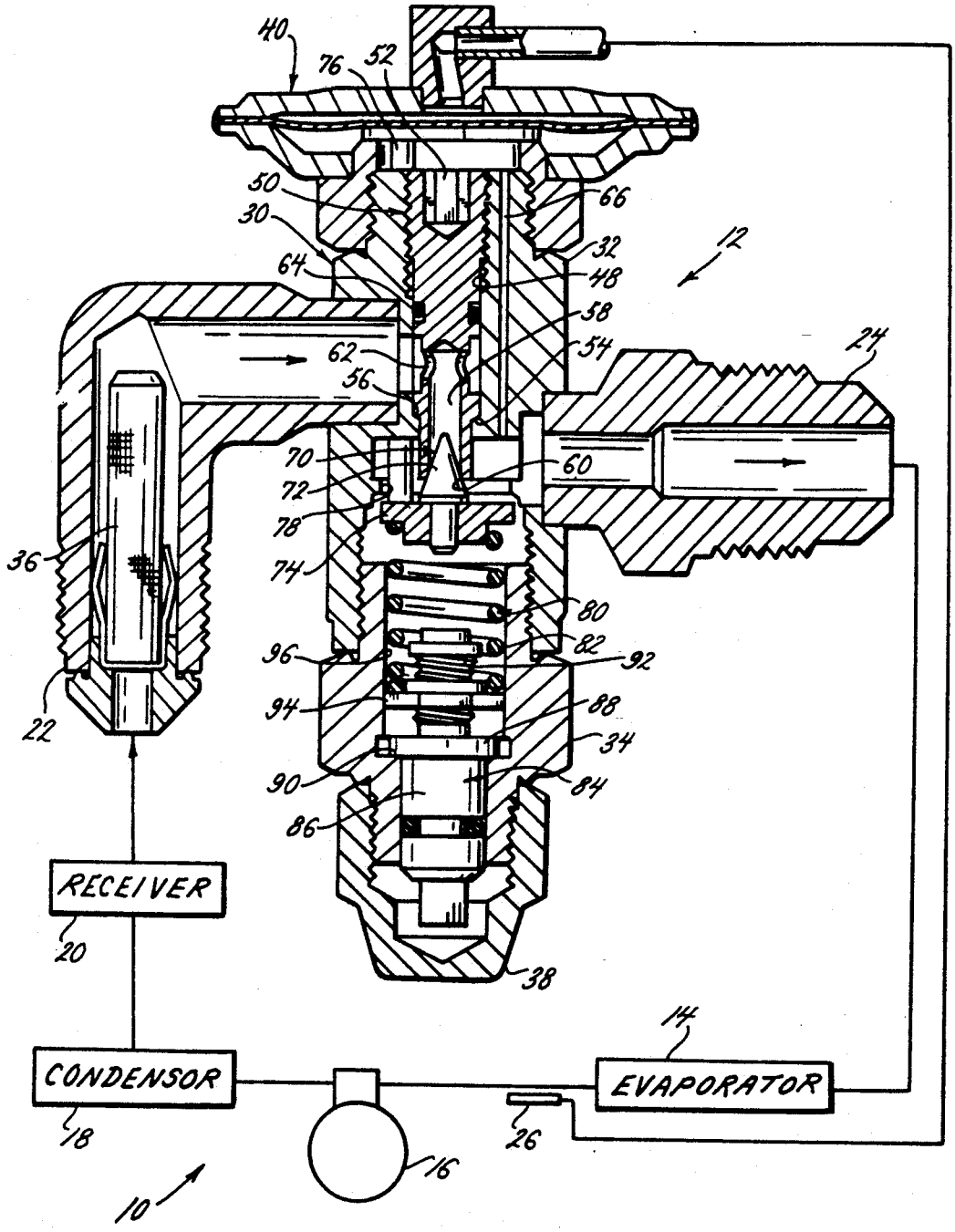
FIG. 1 is a cross sectional view through the valve.

Before describing the preferred embodiment the conventional prior art cartridge valve will be briefly described. Essentially, and as shown in FIG. 5, the prior art valve 200 includes a valve body 202 having an inlet 204 and an outlet 206. A diaphragm assembly is provided at the upper end of the body having a lower portion 210 which is unitarily formed with said body, a flexible diaphragm 211 and an upper portion 212 to which is attached a capillary tube 214 having a temperature sensitive bulb 216 at the end thereof. A pushrod 218 is received within the upper portion of the body having a head engageable by the diaphragm 211 and a lower end engageable with a valve pin 222 within a cartridge 220 mounted within the valve inlet 204. The valve body 202 is counterbored at its upper end to provide a housing for a superheat spring 240 which engages the pushrod head and is retained at its lower end by a sliding retainer 242, the spring compression being adjusted by means of an inclined, threaded stud 246. The cartridge valve pin 222 is biased by a spring 230 into engagement with a valve port 228 of predetermined size at the upper end of the cartridge and the cartridge is open at its lower end to receive a strainer envelope 232 which is held in place by a flare fitting (not shown).

The pushrod responds to pressure on the upper side of the diaphragm to modulate the valve pin. The valve capacity or flow control characteristics of the valve are changed by replacing the cartridge with a cartridge having a different valve port. The flow of refrigerant through the cartridge tends to move the valve pin into a closed position and the mounting of the replaceable cartridge within the inlet precludes the use of solder fittings. The diaphragm has to be compressed against the superheat spring during assembly and is not removable.

Referring now by reference numerals to the drawing of the preferred embodiment, and first to FIG. 1, it will be understood that the improved thermostatic expansion valve 12 is, in the embodiment shown, part of a conventional refrigeration system 10 which includes an evaporator 14, a compressor 16, a condensor 18 and a receiver 20, the valve 12 having an inlet fitting 22 receiving refrigerant from the receiver 20 and an outlet fitting 24 supplying refrigerant to the evaporator 14. The improved valve includes a bulb 26 disposed in heat sensing relation adjacent the outlet of the evaporator outlet 14.

More specifically, the thermostatic expansion valve 12 includes a body 30 having an upper portion 32 and a lower portion 34 threadedly connected thereto. The upper portion 32 includes the inlet fitting connection and the outlet fitting connection, the inlet fitting being provided with a strainer 36.

A diaphragm assembly 40, constituting a motor means, is threadedly connected to the body upper portion 32 and a cap 38 is threadedly connected to the lower portion 34.

In the embodiment shown the valve upper portion 32 includes a threaded passage 48 receiving a cartridge 50.

The cartridge 50 includes an upper end which is threaded and provided with a wrench-receiving socket 52 by which it is installed into the valve body portion 32 and a lower end which includes a shoulder 54 which is engageable with an abutment 56 provided by the body and providing a stop to positively locate the cartridge by limiting axial movement within the body. The cartridge 50 also includes a passage 58 terminating in an open end defining a valve port 60 and communicating with the valve inlet by means of side openings 62. Intermediate its ends the cartridge 50 is grooved to receive an O-ring 64 by which the diaphragm is sealed from refrigerant entering the inlet fitting 22. The chamber below the diaphragm communicates with the outlet fitting 24 by means of a passage 66.

A pin assembly 70 is disposed below the valve port 60 and includes a conical pin 72 and a pin carrier 74. The pin 72 constitutes a valve element and the carrier 74 is connected to the diaphragm assembly by a pair of diametric-ally opposed push rods 76. The valve body includes an abutment 78 which is engageable with the carrier 74 and provides a stop, limiting axial movement of pin assembly 70.

A spring assembly 80 is disposed in the lower portion of the body which exerts and upward force on the pin assembly 70 and constitutes a resilient means. In the embodiment shown, the spring assembly 80 includes a superheat compression spring 82 and an adjustment screw 84. The adjustment screw includes a barrel portion 86 and a head 88 engageable in rotatable elation with an abutment 90. The adjustment screw 84 includes a reduced diameter threaded portion 92 receiving a threaded washer 94 which, in the embodiment shown, is hexagonal in configuration for axial movement within a compatibly configurated passage portion 96 by rotation of the adjustment screw. As shown, the spring 80 extends between the pin carrier 72 and the threaded washer 94 and can be adjustably compressed.

It is thought that the structural arrangement of this valve has been fully understood from the foregoing description of parts but for completeness of disclosure the assembly of these parts and operation of the valve will be briefly described.

One of the advantages of the improved valve is that the pin assembly 70 and the spring assembly 80 can be pre-assembled in the factory. This is achieved by first installing the adjustment screw 84 in the lower portion of the valve body, dropping the superheat spring 82 in place on the threaded washer 94 and emplacing the pin carrier above said spring. When the valve body upper portion is threadedly connected to the lower portion the carrier engages the annular abutment 78. With the diaphragm assembly 40 removed, a selected cartridge 50 can be installed within passage 48 and tightened until abutment 56 is engaged by the cartridge shoulder 54. During this process the bottom of the cartridge 50 defining the valve port 60 engages the pin 72 and pushes it downwardly against the resistance of the spring 82 into the position shown in FIG. 1. The pushrods 76 can then be installed and the diaphragm assembly 40 emplaced. The diaphragm assembly 40 is a self-contained, threadedly attached valve component which can be readily removed and replaced for access to the cartridge 50. It will be understood that the size of the valve port 60 controls the flow of refrigerant between the inlet and outlet fittings and determines the capacity of the valve. The length of the cartridge 50 below the abutment engagement on the other hand determines the preload on the spring 84 and stroke of the pin 72 and also affects the capacity of the valve. The replaceable cartridge 50 is, accordingly, manufacturered in a selection of orifice sizes and lengths. Where a wider range of cartridge fittings is desired a doubled-angled pin 73 as shown in FIGS. 2 and 3 can be used. The smaller angle will typically be thirty-eight degrees (38°), as with the single-angle pin 72, while the wider angle will typically be eighty degrees (80°). FIG. 2 shows the double-angled pin 73 used with the cartridge 50 shown in FIG. 1 and engageable with the upper pin portion. FIG. 3 shows the same double-angled pin used with a cartridge **50*a* having a larger diameter port 60*a*** and engageable with the lower pin portion.

In some instances it is desirable to have superior leak proof connections provided by soldered joints at the inlet and outlet fittings. In this case a modified valve 100 is provided as shown in FIG. 3 in which the inlet fitting 22 is substituted by an inlet fitting 150 provided with a strainer assembly such as shown generally in co-owned U.S. patent application Ser. No. 07/782,065, now abandoned, which eliminates the flare fitting, which is incorporated herein by reference. This elimination of the flare-type fitting is achieved by providing a threaded strainer assembly 160 which includes a closed outer end in the form of a stud 162 adapted to be threadedly connected to the inlet fitting 150 and having an elongate strainer tube 164. The tube 164 is provided with a closure ring 166 which it is received in sliding, sealed relation within inlet vertical passage 152 and is disposed below the entrance to the transverse passage 156. The passage 152 is widened at its lower end 158 to receive a soldered connection 155. It will be understood that the outlet fitting 24 can be similarly modified to suit a soldered connection (not shown).

Also, although the improved thermostatic expansion valve has been described by making particular reference to a preferred cartridge valve, the details of description are not to be understood as restrictive, numerous variants being possible within the principles disclosed and within the fair scope of the claims hereunto appended.

We claim as our invention:

1. A thermostatic expansion valve with replaceable cartridge comprising.

(a) a valve body including upper and lower portions and an inlet and an outlet, (b) a removable motor means at one end of the valve body providing means for modulating the valve, (c) replaceable cartridge means disposed in the valve body upper portion below the motor means and accessible when the motor means is removed, said cartridge means having a passage communicating with the valve inlet and an end opening of predetermined size to define a valve port, (d) a valve element movable relative to the valve port to control flow through the valve port between the inlet and outlet, said flow tending to move the valve element into the open position, (e) means connecting the motor means to the valve element tending to move the valve element in response to modulation of said motor means, and (f) resilient means disposed in the valve body lower portion below the replaceable cartridge means operatively engageable with the valve element, tending to close the valve.

2. A thermostatic expansion valve as defined in claim 1, in which:

(g) the replaceable cartridge has a selected predetermined length to define the stroke of the valve element.

3. A thermostatic expansion valve as defined in claim 1, in which:

(g) the replaceable cartridge includes side openings connecting the passage to the inlet.

4. A thermostatic expansion valve as defined in claim 1, in which:

(g) the upper body portion includes a passage receiving the cartridge in threaded relation.

5. A thermostatic expansion valve as defined in claim 4, in which:

(h) the cartridge includes a non-circular socketed upper end receiving a socket wrench to facilitate installation.

6. A thermostatic expansion valve as defined in claim 1, in which:

(g) the valve element is generally conical and double-angled to suit selected valve ports with a remote end providing a smaller angle.

7. A thermostatic expansion valve as defined in claim 1, in which:

(g) the body upper portion includes an abutment engageable by the cartridge to provide a stop means locating the cartridge in the valve body, the cartridge having a selected length extending from the abutment to determine the stroke of the valve element.

8. A thermostatic expansion valve as defined in claim 1, in which:

(g) the valve element includes a pin and a carrier and the resilient means includes a superheat spring engageable with the carrier, and (h) the body includes an abutment engageable by the carrier to limit upward movement by the carrier whereby the valve element and the superheat spring can be pre-installed with the spring in a compressed condition.

9. A thermostatic expansion valve as defined in claim 1, in which:

(g) the inlet is adapted to receive a strainer assembly in threaded relation and the inlet and outlet are adapted for use with solder connections.

10. A thermostatic expansion valve as defined in claim 1, in which:

(g) the motor means includes a threadedly removable diaphragm assembly to facilitate access to the replaceable cartridge, and (h) the replaceable cartridge is selected from a plurality of cartridges of selected valve port size and selected length to suit a plurality of field conditions.

11. A thermostatic expansion valve with replaceable cartridge comprising:

(a) a valve body including upper and lower portions and an inlet and an outlet, (b) a motor means at one end of the valve body providing means for modulating the valve, (c) replaceable cartridge means disposed in the valve body upper portion below the motor means, said cartridge means having a passage communicating with the valve inlet and an end opening of predetermined size to define a valve port, (d) a valve element movable relative to the valve port to control flow through the valve port between the inlet and outlet, said flow tending to move the valve edflement into the open position, (e) means connecting the motor means to the valve element tending to move the valve element in response to modulation of said motor means, and (f) resilient means disposed in the valve body lower portion below the replaceable cartridge means operatively engageable with the valve element, tending to close the valve, (g) the cartridge including an annular seal to seal the motor means from the inlet. suit a plurality of field conditions.

* * * * *